United States Patent [19]

Koranda

[11] 4,094,254

[45] June 13, 1978

[54] LOCK FOR RAILWAY HOPPER CAR GATE RAILWAY CAR GATE LOCK

[76] Inventor: Clarence J. Koranda, 5042 Lawn Ave., Western Springs, Ill. 60558

[21] Appl. No.: 754,835

[22] Filed: Dec. 27, 1976

[51] Int. Cl.[2] ..... B61D 7/20; B61D 7/26; B61D 49/00; F05B 65/18

[52] U.S. Cl. ..... 105/282 P; 105/308 C; 105/308 P

[58] Field of Search ..... 105/276, 282 R, 282 A, 105/282 P, 308 P, 308 R, 308 C; 323/89 M

[56] References Cited

U.S. PATENT DOCUMENTS

| | | | |
|---|---|---|---|
| 1,972,042 | 8/1934 | Flowers | 105/276 X |
| 2,386,702 | 10/1945 | McBride | 105/282 P |
| 3,035,530 | 5/1962 | Meyers et al. | 105/308 R |
| 3,138,117 | 6/1964 | Dorey | 105/282 P |
| 3,204,166 | 8/1965 | Polcyn, Jr. et al. | 323/89 M X |
| 3,956,996 | 5/1976 | Fischer | 105/282 P |

*Primary Examiner*—Drayton E. Hoffman
*Assistant Examiner*—Howard Beltran

[57] ABSTRACT

A lock for a railway hopper car gate in which a hopper outlet chute defines a discharge opening with a siding platelike gate operating in the opening. An undercarriage structure having a pair of spaced side frames supports the gate for sliding movement relative the opening. An elongated lock shaft extends between and projects through guide slots formed in both side frames with one of the side frames also being formed with a lock hole. A U-shaped handle is fixed to each end of the lock shaft with each handle having a return leg supported for transverse and pivoting movement relative the side frames. A latching shoulder is fixed to the elongated lock shaft and one of the guide slots is formed with a latching notch. Transverse movement of the lock shaft by operation of either handle effects an engagement of one of the handle return legs into the frame hole to thereby lock the gate. In the lock opening operation, a pivoting movement of the lock shaft within both guide slots followed by a subsequent transverse movement effects the engagement of the shoulder within the locking latch, thereby latching the lock in the unlocked position. A projecting apertured lock flange is integrally formed on each end of the lock shaft, and the adjacent side frame is also formed with a hole, whereby a railway car seal may be passed through an apertured lock flange and the adjacent frame hole, whereby pivoting of the shaft to open the lock automatically breaks the car seal.

7 Claims, 8 Drawing Figures

LOCK FOR RAILWAY HOPPER CAR GATE RAILWAY CAR GATE LOCK

BACKGROUND OF THE INVENTION

Many railroad hopper cars of the prior art are formed with chutes having a rectangular discharge opening. A sliding platelike gate operates within this discharge opening. When the opening is closed by the gate, the discharge of any contained lading is prevented. When the gate is operated by capstan means, for example, the gate may be moved from its chute closing position, thereby enabling any contained lading to be discharged through the chute.

In any event, an unauthorized opening of the gate during transit or during the parking of the hopper car, will enable one to have access to the lading. Accordingly, sealed locks have been provided for hopper car gates in the prior art. In many instances, these locks are manually operated and they are so structured that they are relatively inaccessible and cannot be operated from either side of the hopper car. This limited operating position leads directly to many injuries, inasmuch as the gate operator must locate himself beneath a particular side of the hopper car structure. Accordingly, the operator may be required to move around a hopper car to gain operating access to the lock, and any unexpected movement of the hopper car may result in severe injuries to the operator.

SUMMARY OF THE INVENTION

Accordingly, a principal object of this invention is to provide an improved lock for a railway hopper car gate which may be manually opened, closed and sealed from either side of the hopper car with access to an operating handle which does not require an operator to assume a dangerous position beneath a hopper car. This mode of operation eliminates the necessity for an operator to locate the operating end of a lock which may be operable only from one side of the hopper car, thus not only promoting increased safety, but also reducing the time required to operate the lock.

Additionally, the lock is capable of cooperating with the railroad car seal so that any unauthorized tampering of the lock may be readily detected. The lock of this invention is so designed that when the lock is opened a railroad car seal is automatically broken without requiring a separate seal cutting operation by an operator.

DESCRIPTION OF THE DRAWINGS

In order that all of the structural features for attaining the objects of this invention may be readily understood, reference is made to the accompanying drawings wherein.

DETAILED DESCRIPTION OF THE PREFERRED EMBODIMENT

Figures 1, 2, 3:
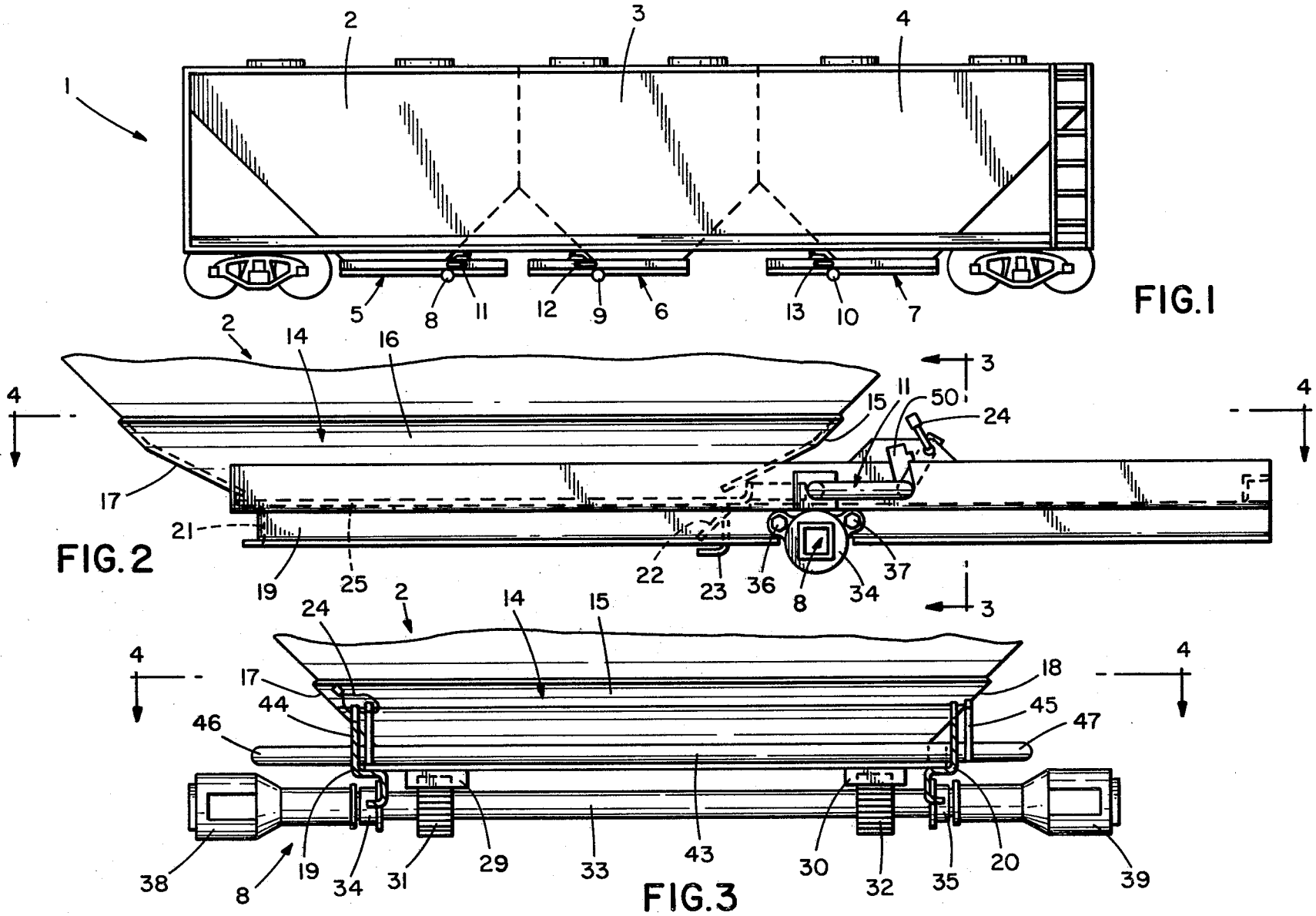
FIG. 1 is a simplified side elevation view of a covered hopper car with each hopper compartment being equipped with a slide gate lock of this invention.
FIG. 2 is an enlarged side elevation view of a portion of a single hopper compartment incorporating a slide gate lock of this invention, with the gate being closed, locked and sealed.
FIG. 3 is a section view taken along line 3—3 of FIG. 2 and showing the lock in the sealed position of FIG. 2.

FIG. 1 shows a covered railway hopper car 1 which is subdivided into three hopper compartments 2, 3 and 4. Each of the hopper compartments 2, 3 and 4 is equipped with a slide gate assembly employing a gate lock of this invention. For example, hopper compartment 2 is equipped with slide gate assembly 5 which is generally shown at the bottom of the hopper chute, and similarly, hopper compartments 3 and 4 are equipped with slide gate assemblies 6 and 7.

Each of the slide gate assemblies 5, 6 and 7 are supported relative to the undercarriage of hopper car 1 by undercarriage frame structure which carries a hopper outlet chute defining a framed discharge opening for granular lading. The slide gate operates within this framed opening so as to contain or release the lading as the gate is operated by capstan assembly 8, shown with respect to hopper compartment 2. Similarly, capstan assemblies 9 and 10 operate the slide gates for hopper compartments 3 and 4, respectively.

With respect to the typical hopper car 1, shown in FIG. 1, the operation of capstan 8 moves the slide gate (FIG. 4) to the right when the gate is opened; the operation of capstans 9 and 10 moves their associated slide gates to the left when these gates are unlocked and opened to permit the release of lading.

Inasmuch as slide gate assemblies 5, 6 and 7 and the associated gate lock assemblies 11, 12 and 13 of this invention are essentially the same for all of hopper compartments 2, 3 and 4, the specific slide gate structure and its lock assembly 11 for hopper compartment 2 will be discussed in detail in the subsequent Figures. It should be understood, however, that slide gate assemblies 6 and 7 and their associated lock assemblies 12 and 13 for hopper compartments 3 and 4 are substantially identical in structure with the exception that, as previously noted, the gates for assemblies 6 and 7 are moved to the left by operation of capstan assemblies 9 and 10 when the hopper compartments are to be opened for release of their contained lading.

The lock of this invention is best shown in FIGS. 3 through 8. In general, the lock can be opened, closed, and sealed from either side of hopper car 1. The lock is designed to receive a railway car seal or a padlock, or both may be used at the same time. When the lock is fully opened, a railway car seal is automatically broken. The lock opening operation is effected by a handle elevating pivoting step, followed by a handle push or pull step, which latches the lock in the open position.

However, prior to discussing the detailed structure of the lock of FIGS. 3 through 8, a description of the general arrangement of hopper chute 14 for hopper compartment 2 is desirable for facilitating the understanding of the invention.

Hopper outlet chute 14 (FIG. 2) employs four inclined sidewalls, namely, rear sidewall 15, near sidewall 16, front sidewall 17 and far sidewall 18 (FIG. 3).

A rectangular discharge opening is defined by the frame formed by sidewalls 15, 16, 17 and 18. This opening is closed by slide gate 25 (FIG. 4), for example, when lading is contained within hopper compartment 2. Accordingly, a discharge outlet for hopper compartment 2 is provided by hopper outlet chute 14 by opening and latching lock 11 and driving gate 25 to the right.

An undercarriage support frame, comprising near side frame 19, far side frame 20 (FIGS. 2 and 3), and front side frame 21 (FIG. 2) are rigidly fixed to the hopper outlet chute sidewalls 15, 16, 17 and 18 by welds. The sidewalls forming hopper compartment 2 are also welded to the upper edges of the sidewalls forming hopper outlet chute 14, so that an integral seal is established between the compartment 2 sidewalls and the hopper outlet chute 14 sidewalls. Accordingly, the only outlet provided for granular lading is through the discharge opening formed when gate 25 is opened.

Inclined frame element 22 extends between and is welded to side frames 19 and 20 to strengthen further the undercarriage support structure. Additionally, element 22 serves as a lading guide baffle during an unloading operation. Angle 23 also extends between side frames 19 and 20 and is welded to the underside of frame element 22. Angle 23 serves as a boot support for an unloading chute (not shown).

Slide gate 25 rests on the undercarriage support frame formed by frame sections 19, 20 and 21. The main body of slide gate 25 is generally rectangular and platelike in shape with all edges of the gate plate, except the front, being formed with an upwardly directed flange. In particular, the rear edge of gate 25 is formed with flange 26, the far side edge of gate 25 is formed with flange 27, and the near edge of the gate is formed with a flange (not shown). The three gate flanges form an integral part of a labyrinth gate seal which is described in detail in applicant's copending application, "Labyrinth Seal for Railway Hopper Car Gate" filed concurrently herewith.

The structure and operation of the lock of this invention may be best understood after a description of the rack and capstan pinion drive for opening and closing gate 25.

In particular, conventional gate drive racks 29 and 30 are rigidly fixed by welding to the bottom surface of gate 25 (see FIGS. 3, 4, 5 and 7). Capstan assembly 8 (FIG. 3) incorporates a pair of pinions 31 and 32 fixed to capstan drive shaft 33. Capstan shaft 33 is rotatably supported on side frames 19 and 20 by shaft support bearings 34 and 35. Each of bearings 34 and 35 is fixed to its associated side frame 19 or 20 by a pair of bolts, such as 36 and 37 for bearing 34 (FIG. 2).

Capstan head assemblies 38 and 39 are rigidly fixed to the terminal ends of capstan drive shaft 33 (FIG. 3). Accordingly, insertion of a capstan drive bar within any capstan head opening rotates the drive shaft 33 and the accompanying pinions 31 and 32. The rotation of the pinions 31 and 32 drives racks 29 and 30, respectively, and inasmuch as the racks are rigidly fixed to gate 25, the gate opens and closes responsively to the direction of rotation of drive shaft 33.

Figure 7:
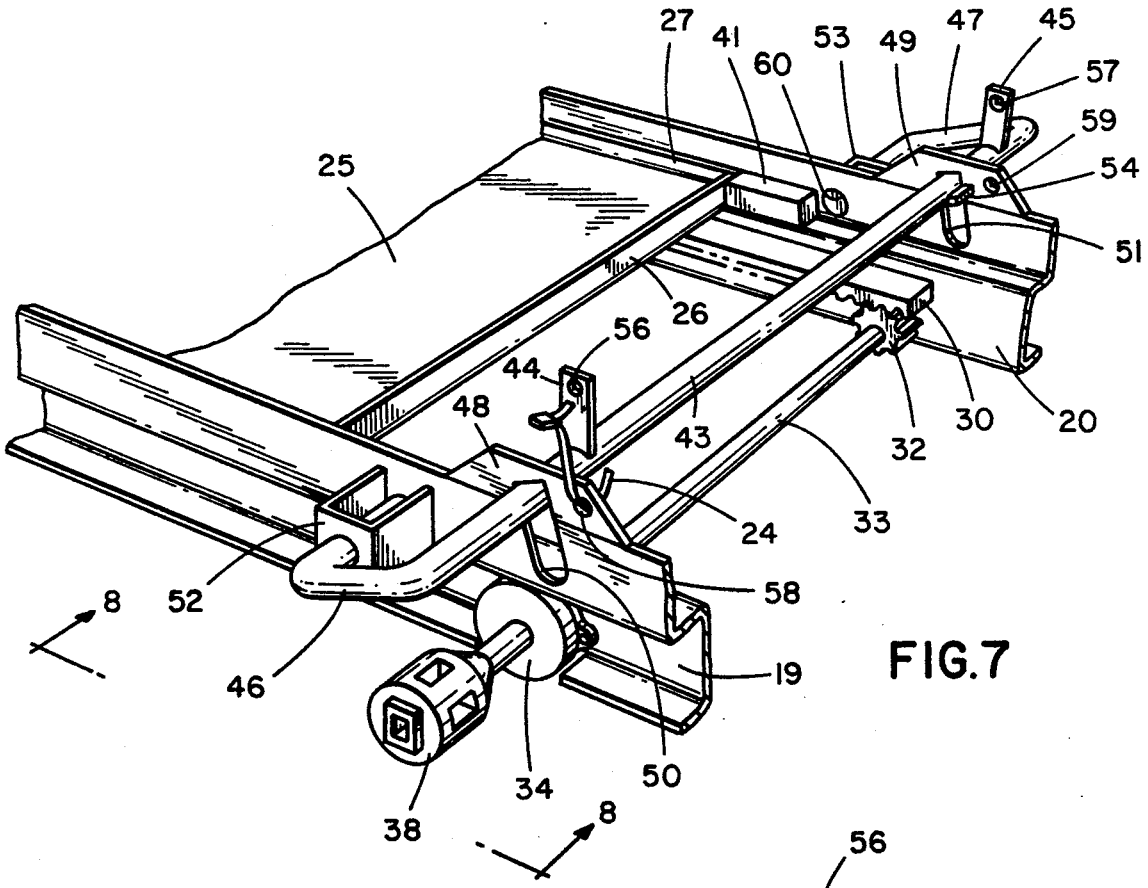
FIG. 7 is a fragmentary perspective view of the hopper gate assembly with the gate in an unlocked position with the seal broken.
Figure 8:
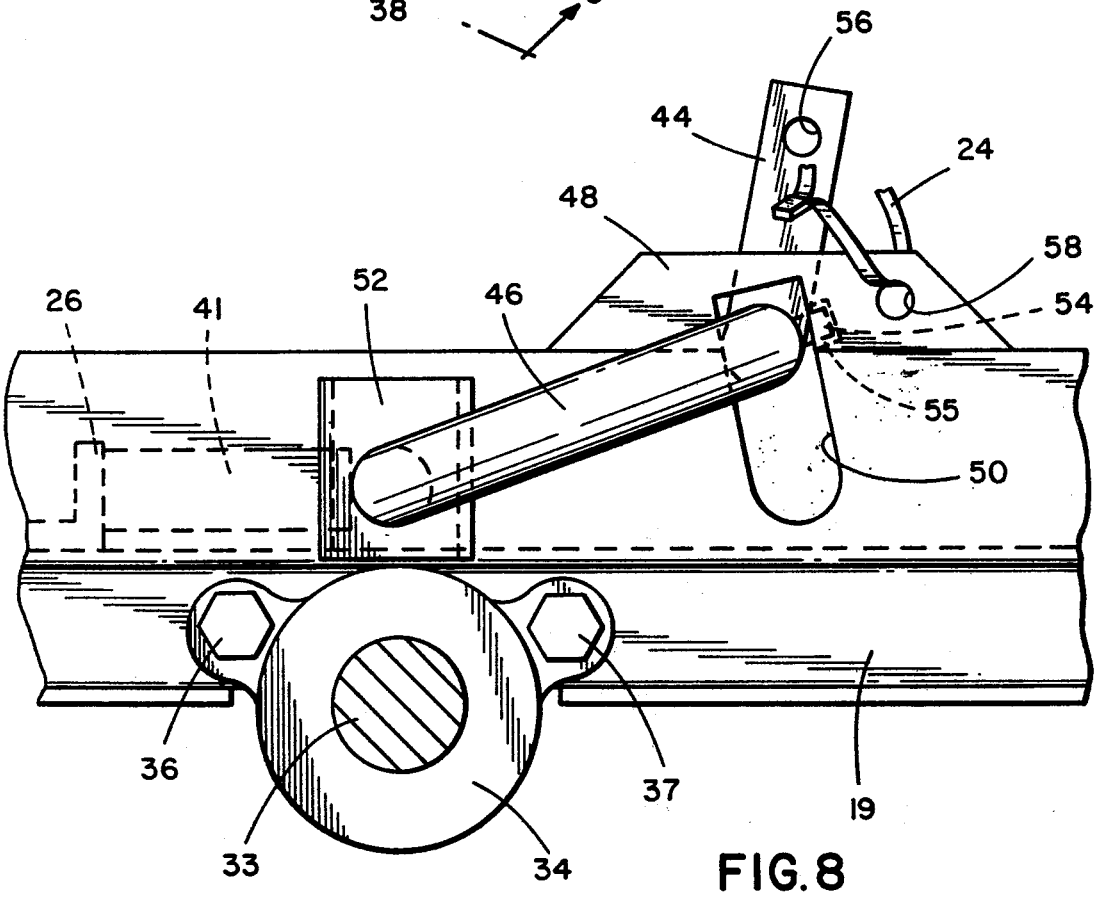
FIG. 8 is an enlarged side elevation view taken along lines 8—8 of FIG. 7 and showing details of the lock in the open position with the seal broken.

In FIGS. 2 through 6, gate 25 is shown closed, locked and sealed; and in FIGS. 7 and 8, lock assembly 11 has been elevated and shifted (by a push or pull operation) so as to break car seal 24, unlock the gate, and latch lock assembly 11.

Figure 4:
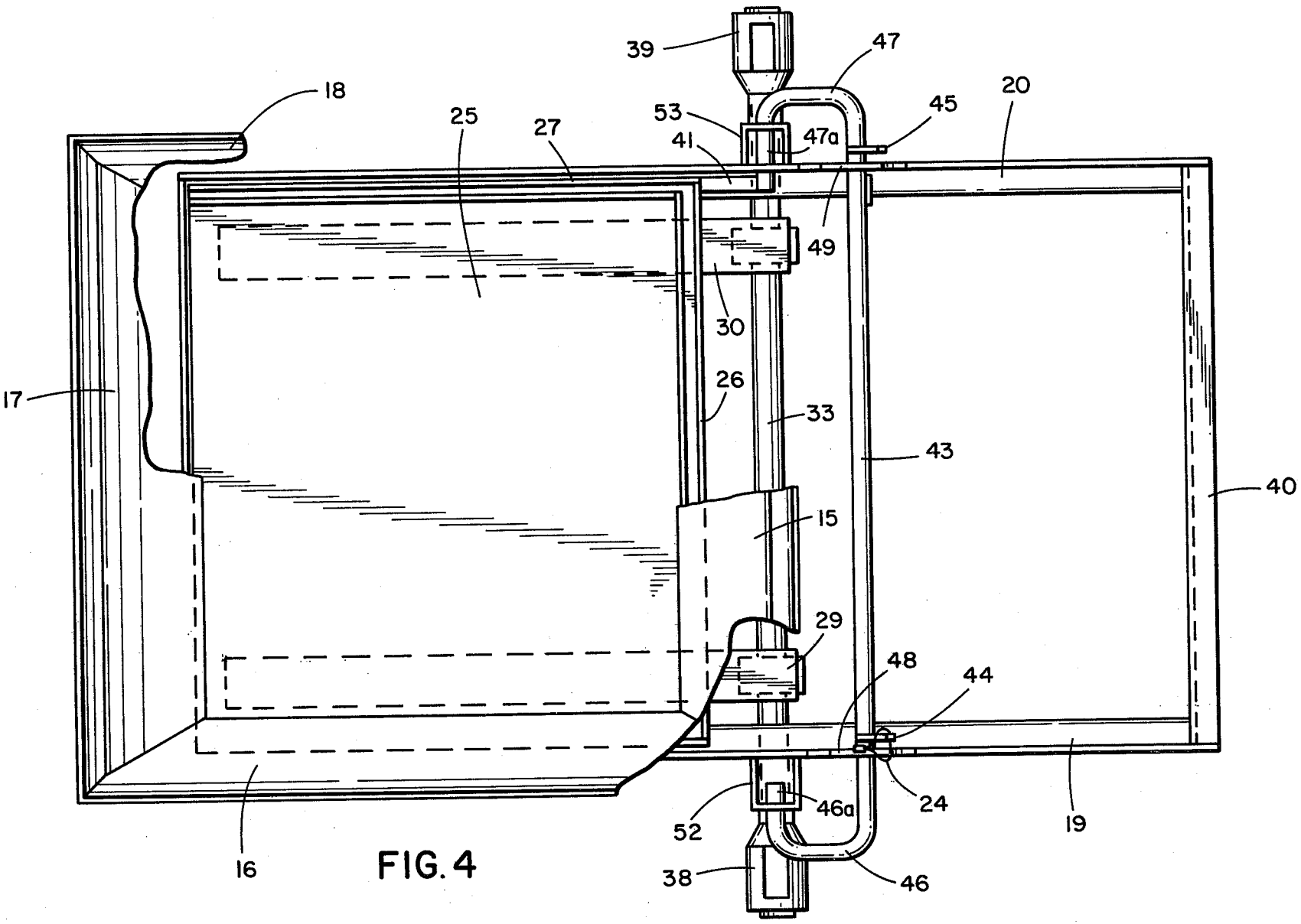
FIG. 4 is a section view taken along line 4—4 of both FIGS. 2 and 3 with portions of the gate being broken away to show details of the lock with the gate in a closed, locked and sealed position.

As is best shown in FIG. 4, gate stop 40 which is a right angle bar, spans the distance between side frames 19 and 20 and is rigidly fixed to the rear terminal portions of these frames. Accordingly, the maximum opening of gate 26 is limited by gate stop 40. For example, in FIG. 4 gate 26 can be opened to the maximum opening distance which occurs when rear gate flange 26 strikes gate stop 40. Stop block 41 is fixed to the right side of flange 26 and moves therewith, riding on side frame 19. In the open position of the gate, block 41 projects through a rectangular opening (not shown) formed in gate stop 40.

A counterclockwise rotation of capstan assembly 8 will close gate 25 so that the hopper outlet chute 14 will be sealed so as to contain any lading loaded within hopper car compartment 2.

Lock assembly 11 may be sealed by car seal 24 to indicate that gate 25 has not been tampered with and subjected to an unauthorized opening.

In general, lock assembly 11 comprises a cylindrical shaft 43 formed with integral or rigidly fixed lock flanges 44 and 45 (FIGS. 3–6). The terminal portions of shaft 43 are formed with U-shaped operating handle portions 46 and 47.

Each of side frames 19 and 20 is formed with a projecting frame extension flange 48 and 49, respectively. The frame-flange combination 19,48 is formed with a lock guide slot 50; and the frame-flange combination 20,49 is formed with a lock-guide slot 51. Lock shaft 43 extends between and through slots 50 and 51.

Handle end segments or return legs **46*a* and 47*a* are carried for pivotal and sliding movement relative side frames 19 and 20 by U-shaped yoke bearings 52 and 53 which are rigidly fixed to side frames 19 and 20**.

An elongated latching barlike shoulder 54 is fixed to shaft 43 adjacent guide slot 51. Guide slot 51 is formed with a latching notch or recess 55 which receives shoulder 54 when lock assembly 11 is latched, as hereafter outlined.

Each of lock flanges 44 and 45 is formed with a seal or padlock hole 56 or 57; and each of frame extension flanges 48,49 is also formed with a seal or padlock hole 58,59. When lock assembly 11 locks slide gate 25, a seal 24 may be inserted through hole pair 56,58 (FIGS. 2–6) or through hole pair 57,59 to serve as an indication that the lock 11 has not been opened. In the event that the lock has been opened, seal 24 will be ruptured (FIG. 8).

Side frame 20 is formed with a locking hole 60 (FIG. 7). When handle return leg **47*a* projects into hole 60 (FIG. 5), contact is made with stop block 41 to lock gate 25** in the closed position.

Figure 5:
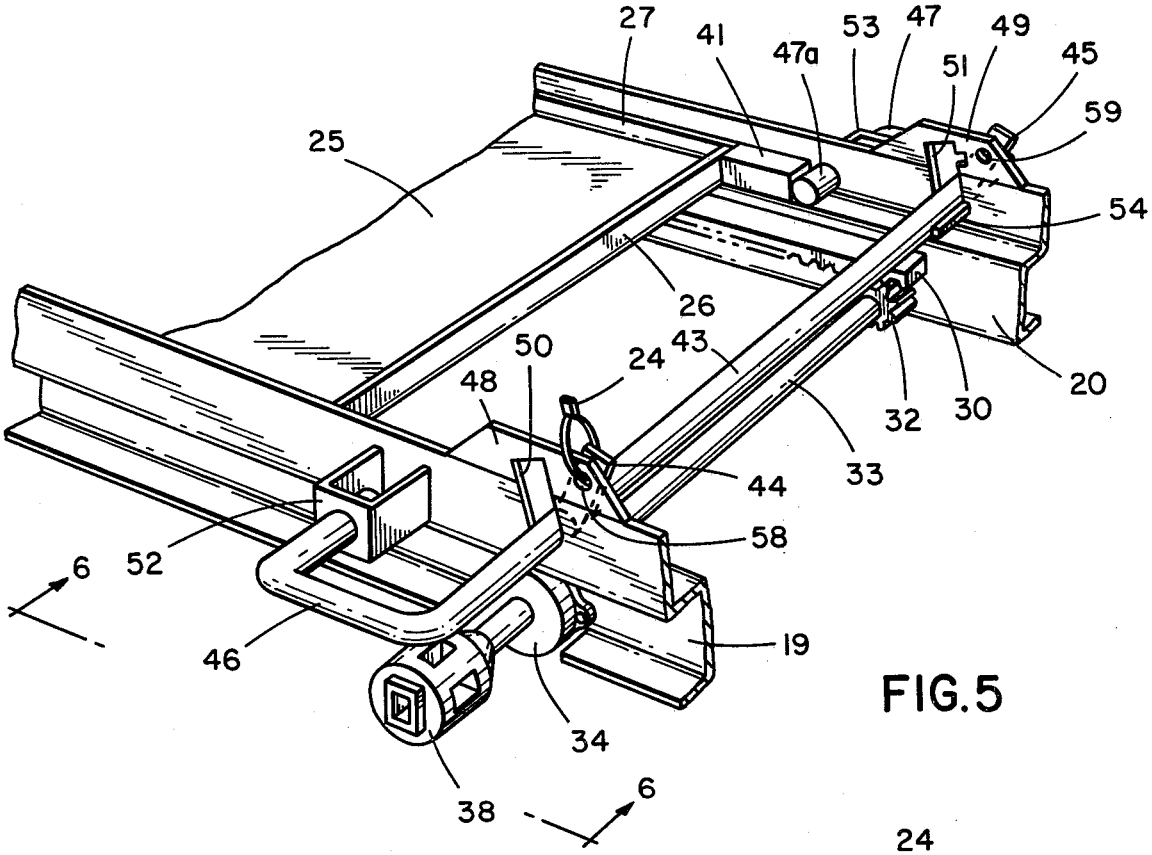
FIG. 5 is a fragmentary perspective view of the hopper gate assembly with the gate in a closed, locked and sealed position.
Figure 6:
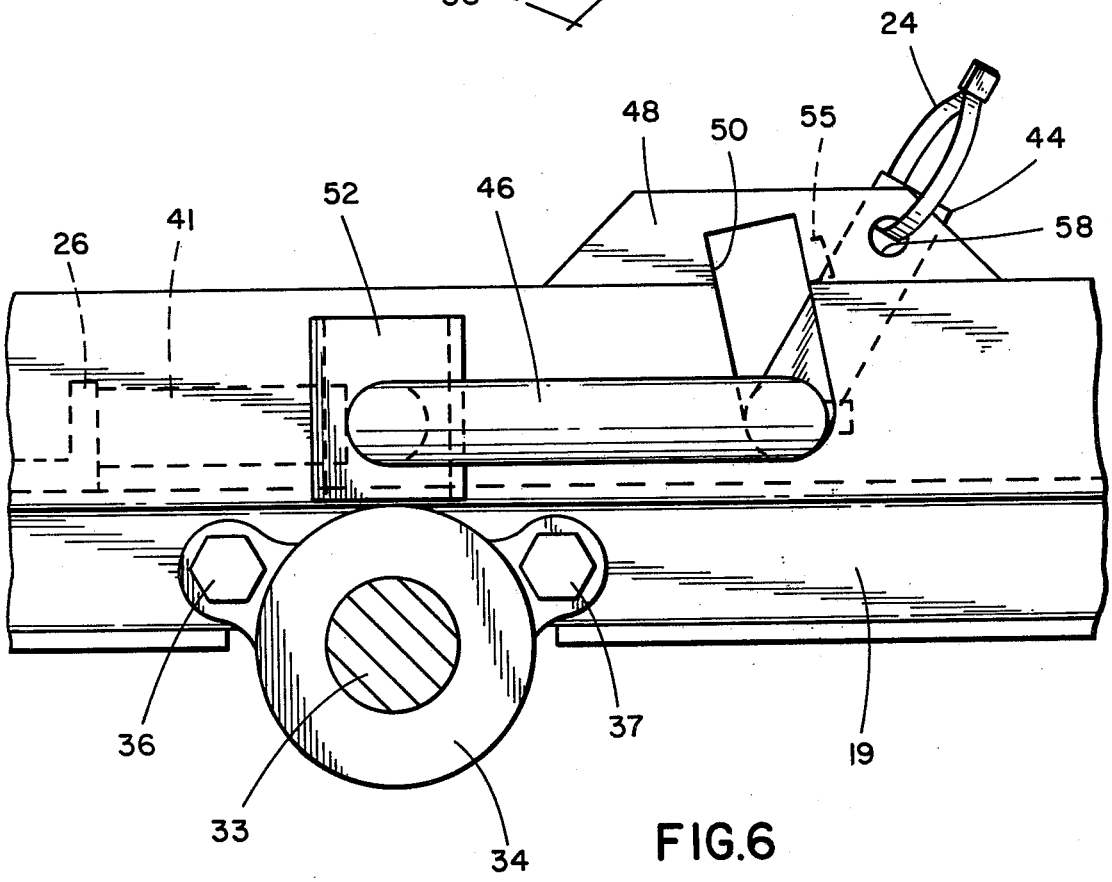
FIG. 6 is an enlarged side elevation view taken along lines 6—6 of FIG. 5 and showing details of a sealed lock.

The detailed operation of lock assembly 11 is as follows:

In the gate 25 locking function, lock handle portion 46 is manually pushed, or lock handle portion 47 is manually pushed so that handle return leg **47*a* projects into the path of stop block 41 (FIGS. 4,5). Accordingly, operation of capstan 8 in the gate 25 opening direction is ineffective to move gate 25 in view of the obstruction presented by leg 47*a*. It should be noted in the gate locked position, lock shaft 43 rests on the bottom edges of lock guide slots 50,51; and also latching shoulder 54 lies wholly within side frame 20. Seal 24 may be inserted within either of hole pairs 56,58 or 57,59** to insure the integrity of the lock.

In the gate 25 opening function, either handle portion 46 or 47 is manually grasped and shaft 43 is pivoted upwardly within guide slots 50 and 51 to assume the elevated position shown in FIGS. 7 and 8. Handle return legs 46*a* and 47*a* pivot within yoke bearings 52 and 53. Thereafter, when latching shoulder 54 is aligned within latching notch 55, handle portion 46 is manually pushed or handle portion 47 is manually pulled. With this operation, seal 24 is automatically broken, leg 47*a* is withdrawn, and shoulder 54 is received within notch 55. Lock assembly 11 is thus latched in the open position, and capstan assembly 8 may be rotated to open gate 25, thereby effecting unloading of any lading contained within compartment 2.

Locking is again effected by closing gate 25, and pulling handle portion 46 or pushing handle portion 47, to remove latching shoulder 54 from notch 55. Lock shaft 43 is thereby pivotally lowered in guide slots 50 and 51. The positioning of leg 47*a* against stop block 41 locks gate 25.

It should be understood that the above described arrangements are merely illustrative of the principles of this invention, and that modifications can be made without departing from the scope of the invention.

What is claimed is:

1. In a lock for a railway hopper car gate in which a hopper outlet chute defines a discharge opening with a sliding plate gate operating in the opening and an undercarriage structure having a pair of spaced side frame means supporting the gate for sliding movement relative the opening, the improved gate lock comprising an elongated lock shaft extending between and projecting through guide slots formed in both side frame means with one of the frame means also being formed with a locking opening, handle support means associated with each side frame means, a handle fixed to each of the shaft ends with each handle having a return leg supported by its associated handle support means for transverse and pivoting movement relative each frame means whereby an initial pivoting movement of the lock shaft about both return legs and a subsequent transverse movement of the lock shaft by operation of either handle effects an engagement of one of the return legs into the locking opening to thereby lock the gate.

2. The combination of claim 1 in which the locking opening is a hole which receives a handle leg to enable projection of the leg into a gate opening path to obstruct thereby an opening movement of the gate.

3. The combination of claim 2 in which each handle is generally U-shaped in configuration with each handle being located on opposite sides of the spaced frame means.

4. The combination of claim 3 in which a projecting apertured lock flange is formed on the lock shaft and in which one of the side frame means is also formed with a hole, whereby a railway car seal may be passed through the apertured lock flange and the frame hole whereby pivoting of the shaft to open the lock automatically breaks the car seal.

5. The combination of claim 3 in which latching means is fixed to the elongated lock shaft and one of the guide slots is formed with means for receiving the latching means, whereby a pivoting movement of the shaft within both guide slots followed by a subsequent transverse movement effects engagement of the latching means within the receiving means, thereby positioning the lock in the unlocked position.

6. The combination of claim 5 in which the latching means is a projecting shoulder and the receiving means is a latching notch.

7. The combination of claim 5 in which a projecting apertured lock flange is formed on the lock shaft and in which one of the side frame means is also formed with a hole, whereby a railway car seal may be passed through the apertured lock flange and the frame hole whereby pivoting of the shaft to open the lock automatically breaks the car seal.

* * * * *